US006012409A

United States Patent [19]

Mele

[11] Patent Number: 6,012,409

[45] **Date of Patent: *Jan. 11, 2000**

[54] ANCHORING OF OBJECTS

[76] Inventor: Peter C. Mele, P.O. Box 533, Crown Pt, N.Y. 12928

[ * ] Notice: This patent is subject to a terminal disclaimer.

[21] Appl. No.: 09/174,725

[22] Filed: Oct. 19, 1998

Related U.S. Application Data

[63] Continuation-in-part of application No. 08/808,010, Mar. 3, 1997, Pat. No. 5,823,133.

[51] Int. Cl.[7] ..... B63B 21/32

[52] U.S. Cl. ..... 114/301; 114/303

[58] Field of Search ..... 114/301, 302, 114/303, 304, 307, 306

[56] References Cited

U.S. PATENT DOCUMENTS

| | | | |
|---|---|---|---|
| 2,490,583 | 12/1949 | Dunkelberger | 114/303 |
| 2,863,415 | 12/1958 | Schofield | 114/303 |
| 4,250,828 | 2/1981 | Cota | 114/307 |
| 5,404,831 | 4/1995 | Miller | 114/306 |

*Primary Examiner*—Stephen Avila
*Attorney, Agent, or Firm*—George E. Kersey, Esq.

[57] ABSTRACT

Method and apparatus for the anchoring of a floating object by an elongated shank having an attached fluke that extends along the vicinity of the shank, with an edge of the fluke extending to a tip from a constraint movably mounted on the shank, with the fluke apertured and proportioned to limit fouling by a rode attached to the shank and facilitate attachment for storage.

20 Claims, 9 Drawing Sheets

ANCHORING OF OBJECTS

This is a continuation-in-part of Ser. No. 08/808,010, filed Mar. 3, 1997 now U.S. Pat. No. 5,823,133. The invention relates to the anchoring of objects, such as boats and vessels, and more particularly, to the anchoring of boats and vessels in marine areas where an ocean floor is substantially occupied by weeds and other marine growth.

Anchoring in marine environments is generally achieved using a heavy implement that is attached to a length of material, such as chain or cable in the case of a large vessel, or a rope "rode" in the case of a smaller vessel. The anchor typically is carried on deck or "stowed" in a suitable housing so that it may be dropped quickly to a fluid sea bottom, to either stop the vessel or hold it in a desired position.

If a dropped anchor has sufficient "scope", i.e. length of cable or chain, there is a resulting catenary curve between the vessel and anchor that will act as a spring. Under ordinary conditions the spring action of the cable or chain will absorb successive strains or surges and keep the vessel under control without disturbing the "bite" of the anchor.

The main reason for the sufficient scope (5 or 10 to 1) is to present the anchor, as nearly as possible, with a horizontal pull to allow a digging action by the anchor since a vertical pull on the anchor could dislodge it easily.

For suitable anchoring to take place it is necessary that an adequate bite be established. If the fluid bottom contains marine accretions, such as weeds, or if the fluid bottom is irregular, it may be difficult to establish a suitable bite.

Accordingly it is an object of the invention to facilitate the establishment of a suitable bite when anchoring is to take place. A related object is to establish a suitable bite in the presence of marine accretions such as weeds, milfoil, kelp and other marine deposits and growths. Another object is to facilitate the establishment of a suitable bite where the fluid bottom is irregular, rocky, or of any other surface type.

Instruments for the mooring of vessel have been in use for centuries. Egyptian tombs before 2000 B.C. include ship models equipped with conical stake anchors attached to papyrus ropes. Later anchors were in the form of grooved or perforated stones, known as "killicks", having various forms, including "T" shapes. Crooked sticks or wooden frames were weighted with stones.

In Roman times iron-tipped oaken anchors had heavy leaden stocks, which were disposed at a right angle on a shank above the flukes by which bottom contact was made. In some cases the stock was "portable" in that it could be removed and stored separately.

Iron anchors are believed to have been first forged in England and evolved into old style "Admiralty" anchors with a long shank extending to two sharply pointed straight arms, or flukes, at right angles to the shank, and large wooden stocks or cross-pieces at the other end of the shank.

These anchors were of poor quality, laboriously manufactured by hand, and were needed in large numbers to provide for suitable anchoring. They later were replaced by anchors with tumbling flukes, tripping anchor-palms and stockless shanks. Although anchors with stocks continue to be used, they are extremely awkward to handle and, when in position, the upstanding arm or stock may foul a chain or pierce the hull of a vessel.

Later an anchor shaped like a mushroom appeared for permanent moorings, and is still in wide use for the anchoring of buoys, particularly in very soft, muddy river bottoms. This anchor is unsuitable where there are marine accretions, such as weeds at the fluid bottom.

Currently the most common anchor is of the stockless tumbling fluke type that is stowed in a "hawse" pipe, i.e. a pipe in a hole of a ships bow though which a hawser or anchor cable is passed. Like the mushroom anchor, this anchor can be unsuitable where there are marine accretions, and needs to be massive, making it unsuitable for small vessels.

Accordingly it is a further object of the invention to avoid the need for stockless tumbling fluke anchors for the mooring of vessels where there are marine accretions. A related object is to provide an anchor that is suitable for small vessels.

Although lightweight head-stocked anchors have been used on small vessels, they require holding-ground that is penetrable. A further object of the invention is to achieve suitable mooring where the holding ground is not penetrable, because of, for example, rockiness or a hardened surface, but weight saving is desired.

It is still another object of the invention to facilitate the anchoring of vessels at relatively difficult locations, such as those with marine accretions such as weeds.

SUMMARY OF THE INVENTION

In accomplishing the foregoing and related objects, the invention provides for the anchoring of floating objects by an elongated shank with a constraint movably mounted thereon. A fluke, i.e., a pointed part of an anchor designed to catch in the ground, is attached to the constraint and extends along the vicinity of the shank.

A further fluke can be attached to the constraint and extend along the vicinity of the shank. The further fluke is attached to the original fluke by a further constraint.

In accordance with one aspect of the invention, the further constraint has a planar or curved segment joining the flukes, and the original constraint is semi-cylindrical. A second further fluke can be attached to the constraint and extend along the vicinity of the shank.

In accordance with another aspect of the invention, the fluke is triangular or semi-circular with a inside edge extending from the constraint to a tip. The fluke has an apex opposite its base proportioned to limit fouling by a rode attached to the shank. In addition, the fluke is proportioned at its apex to facilitate attachment thereto for storage, for example by being apertured.

Additional flukes can be connected to the shank and the constraint with uniform distribution therearound. Each fluke can be planar and have its tip reinforced by a "V"-shaped member that extends along the base and can cradle the shank when pulled at an angle.

In a method of fabricating apparatus for the anchoring of floating objects, the steps include (a) providing an elongated shank; (b) movably mounting a constraint on the shank; and (c) attaching a fluke to the constraint to extend along the vicinity of the shank.

The method can further include the step of attaching a further fluke to the constraint to extend along the vicinity of the shank, and attaching the further fluke by a further constraint.

The method can further include the step of joining all the flukes by further constraints.

In a method of anchoring a floating object, the steps include (a) lowering to a fluid floor an anchor having a plurality of separated planar flukes with elongated, forward outside edges that can have a variety of shapes, such as being concave; (b) penetrating marine growth by the flukes to reach the fluid floor; and (c) positioning the elongated edges of the flukes against the fluid floor. The invention provides suitable anchoring in the face of adverse fluid bed environments because when the anchor of the invention is let down, it presents no horizontal or concave surface to hook weeds and carry them to the bottom under the anchor since the hooking of weeds and other debris could interfere and even prevent anchor penetration of the sea bed.

In addition, the flukes of the invention straddle marine growth on the sea bottom, and, on pulling, the non-aligned edges of the flukes quickly create friction which tips the anchor on to two contact points of the flukes for rapid penetration before weed accumulation can occur.

Described in general terms, the anchor of the invention has three or more radially oriented flukes or blades which may take a variety of forms including corded segments of circles. Where there are three blades, they are spaced apart by 120 degrees and for n blades the spacing is 360/n degrees. One or more constraints position the blades, which may have ribs, flanges or bends for reinforcement. A shank is removably attached to the constraint or constraints by a cylindrical or other housing, such as a bell clapper, which may have grooves on front and rear inside edges to aid alignment of the shank with the blade flukes.

The invention also provides apparatus for the anchoring of a floating object by an elongated shank with a constraint retractably mounted on the shank and a fluke attached to the constraint and extending along the vicinity of the shank.

A further fluke can be attached to the constraint and extend along the vicinity of the shank. The constraint can be triangular with an aperture therein for retractable mounting on the shank.

The shank can include an aperture therein for receiving means by which the retraction of the constraint along the shank can be limited. The fluke can be displaceably mounted on the constraint, and the fluke can be selected from the class of planar and non-planar flukes.

The fluke can be directly attached to the constraint, which loosely surrounds the shank, and the shank can be terminated by means for retaining the constraint on the shank, such as an end cap or an aperture extending through the shank displaced from the end thereof for receiving means for retaining the constraint retractably on the shank. The shank further can include means at an intermediate position therealong for limiting the retractability of the constraint. The limiting means can comprise an aperture extending through the shank for receiving means for retaining the constraint retractably on the shank.

In a method of the invention for fabricating apparatus for the anchoring of floating objects, the steps can include (a) providing an elongated shank; (b) retractably mounting a constraint on the shank; (c) attaching a fluke to the constraint to extend along the vicinity of the shank.

The method can further include the step of displacably attaching the fluke to the constraint. The method also can include the step of providing means at an intermediate location of the shank for limiting the retractability of the constraint. The shank can be terminated with means for retaining the constraint on the shank.

In a method of the invention for anchoring of a floating object, the steps include (a) lowering to a fluid floor an anchor having a fluke with an elongated edge; (b) penetrating marine growth by the fluke to reach the fluid floor; and (c) positioning the elongated edge of the fluke against the fluid floor.

The method can further include the step of lowering the anchor with a plurality of flukes uniformly distributed about a shaft of the anchor. The flukes can have edges that form tips for being caused to penetrate the fluid floor to enhance the anchoring of the floating object.

A rode can be attached to the anchor to control the lowering thereof to the fluid floor and adopt the configuration of a catenary to promote the anchoring.

DESCRIPTION OF THE DRAWINGS

Other aspects of the invention will become apparent after considering several illustrative embodiments, taken in conjunction with the drawings in which.

DETAILED DESCRIPTION

Figure 1:
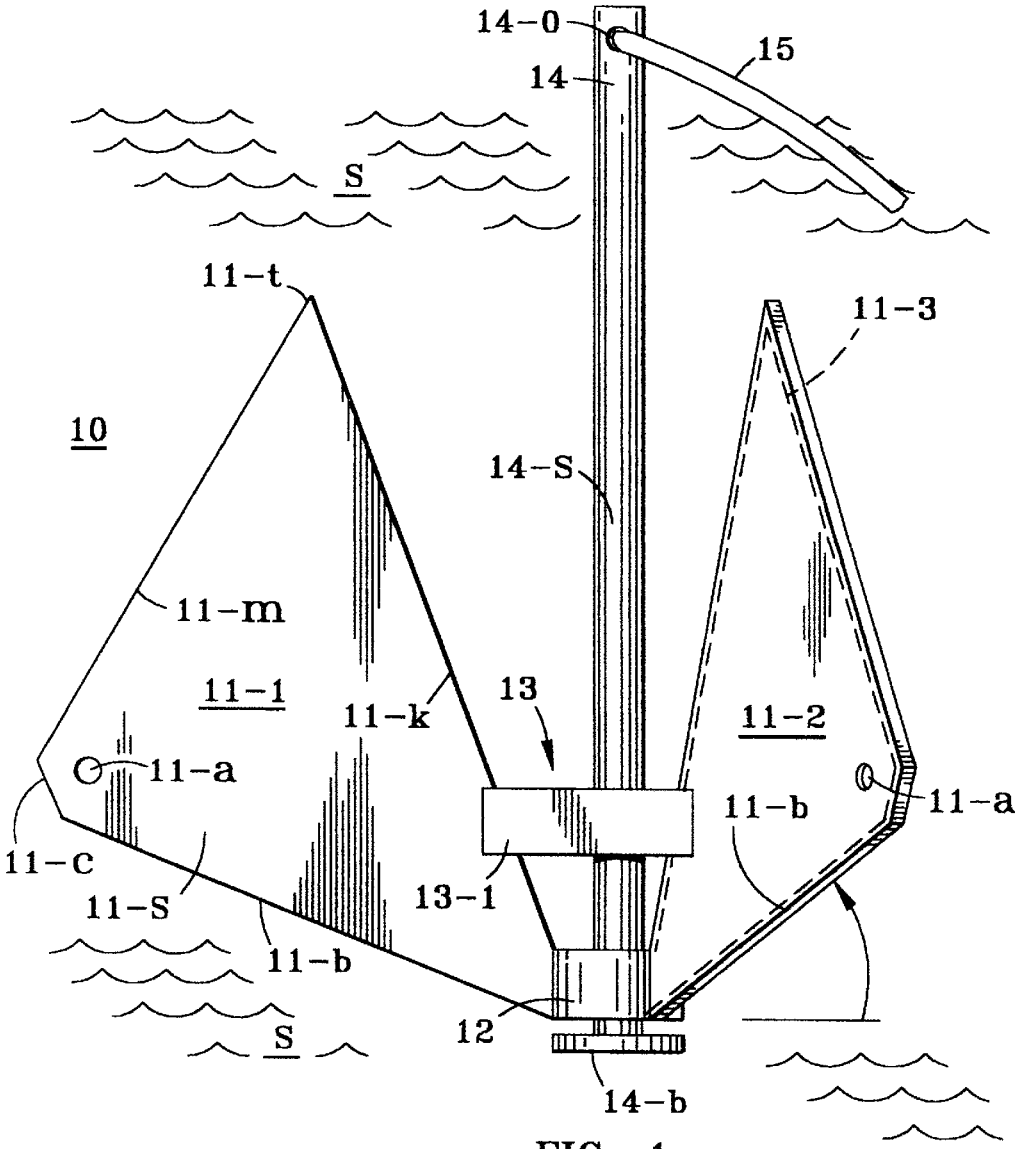
FIG. 1 is a side view of a marine anchor in accordance with the invention, standing upright with three flukes above a surface.

With reference to the drawings, a marine anchor 10 of the invention is shown in FIG. 1 as formed by a set of flukes 11-1, 11-2 and 11-3 which are mounted on a circular constraint 12 and maintained in separated position by a triangular constraint 13, with parts 13-1, 13-2 and 13-3.

It will be appreciated that the constraint 12 may adopt a wide variety of forms and be, for example, triangular, and that the triangular constraint 13 may also adopt a wide variety of other forms and be for example, circular.

In the view of FIG. 1, the anchor 10 has been positioned above a surface S, out of water, with the fluke 11-1 having its base edge **11-*b* directly above the surface S, and the corresponding edges 11-*b* of the remaining flukes 11-2 and 11-3** are elevated above the surface S.

Extending through the circular constraint 12 is a shank 14 by which the anchor 10 can be elevated and lowered into position on a marine surface. A rode or cable 15 is attached to the end of the shank 14 for that purpose and is seen hanging loosely in FIG. 1.

Besides the base edges **11-*b*, each fluke 11-1, 11-2 and 11-3 has a truncated triangular surface 11-*s* extending from a constraint edge 10-*k* that extends to a tip 11-*t* and then to a marine surface contact edge 11-*m*. At the end of the marine contact edge 11-*m*, opposite the tip 11-*t*, is a truncated corner 11-*c*, which meets the base edge 11-*b***.

Figure 2:
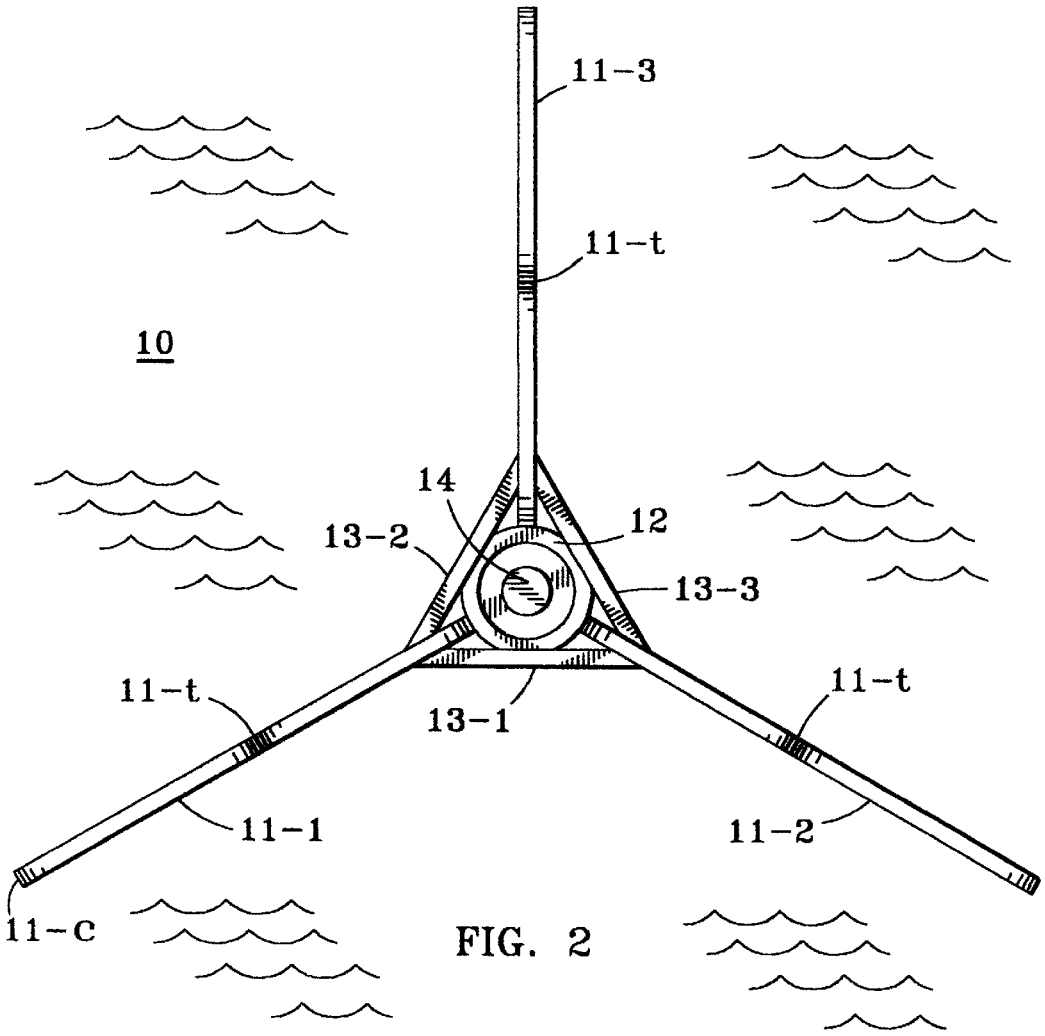
FIG. 2 is a top view of the marine anchor of FIG. 1, as seen when being lowered into water.

The constraint edge **11-*k* of each fluke 11-1, 11-2 and 11-3 is attached to both the circular constraint 12 and the respective parts 13-1, 13-1 and 13-3 of the triangular constraint 13, as more clearly shown in FIG. 2**.

The inside rear edge of the circular constraint 12 may have a filed groove (not shown) to aid alignment of the associated shank and fluke.

Inserted through the constraints 12 and 13 is the shank 14 that includes a shaft 14-*s*, a base 14-*b* and an attachment opening 14-*o* for a "rode" or other form of cable or wiring 15 by which the anchor 10 may be elevated and lowered in relation to the marine implement, such as a boat (not shown) that is being controlled.

As indicated in FIGS. 1 and 3, the shank 14 is loosely centered on the constraints 12 and 13. In addition to confining the shank shaft 14-*s* within the inside edges 11-*k* of the flukes 11-1, 11-2 and 11-3, the circular constraint 12 acts against the shank base 14-*b* and the triangular constraint 13 further restricts the movement or play of the shank 14.

It will be understood that while an overall triangular configuration is preferred for the constraint 13, because it defines a constraining area which promotes the movement and alignment of the shank 14 in relation to the inside edge 11-*k* of each fluke 11-1, 11-2 and 11-3, other shapes may be used as well.

The shank base 14-*b* is movable in relation to the circular constraint 12, which prevents the shank 14 from being pulled away from the anchor 10. The shank opening 14-*o* for connection to an anchor rode is at the opposite end of the shank shaft 14-*s*, but it may be located elsewhere as well.

As the anchor 10 is dropped into water, it is seen from above as shown in FIG. 2. The flukes 11-1, 11-2 and 11-3 are substantially distributed around the circular constraint 12 and one of the segments 13-1, 13-2 or 13-3 spans the approximately 120 degree interval between adjoining flukes. Each fluke tip 11-*t* appears about midway between the corner 11-*c* and the circular constraint 12.

Figure 3A:
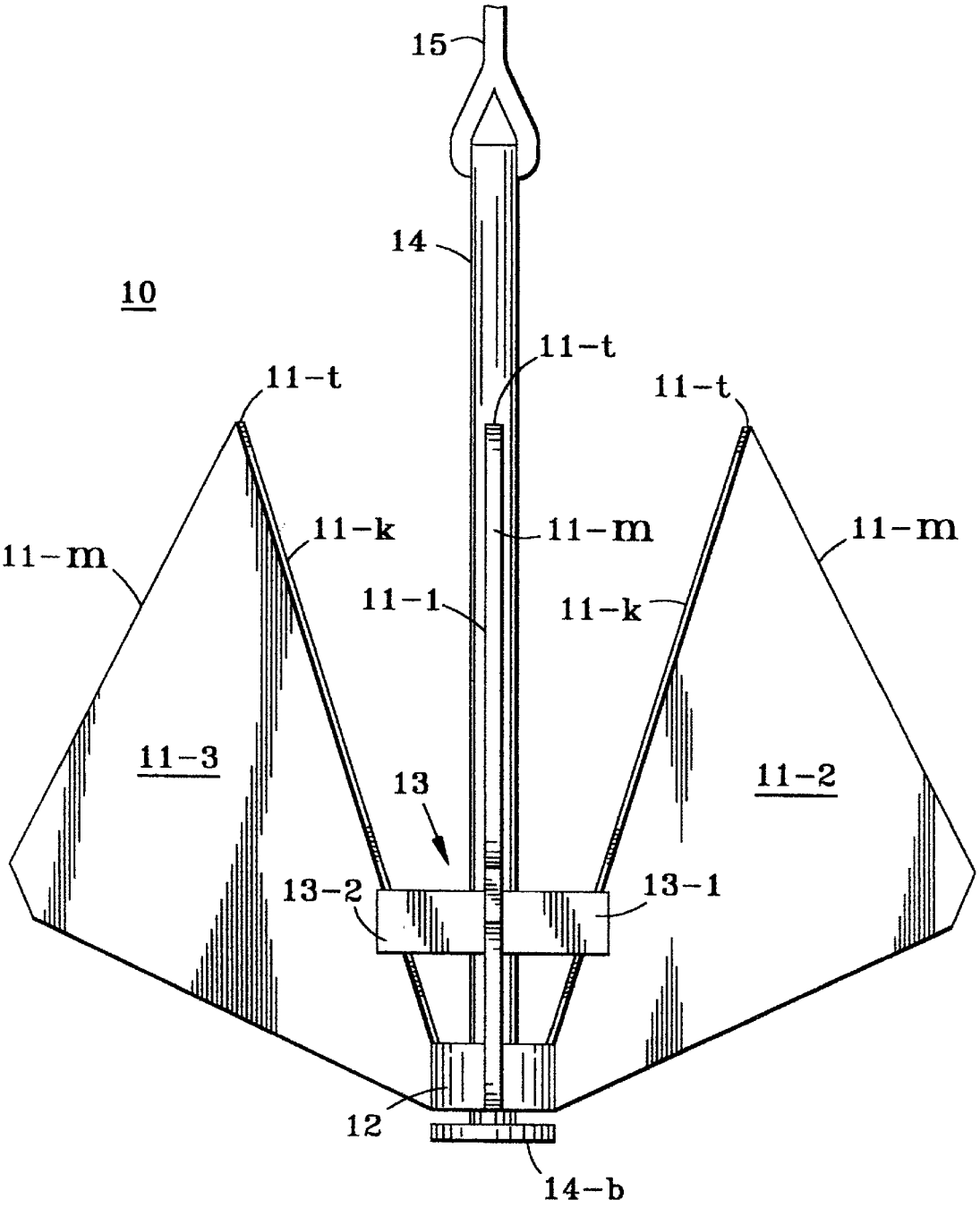
FIGS. 3A and 3B are respective top and side views of the marine anchor of FIG. 1, as seen after having been dropped into contact to dig into a water covered surface.

When the anchor 10 reaches the marine floor, it takes on the appearance, again as seen from above at an angle, as shown in FIG. 3A, rests on only two of its edges 11-*m*. If the anchor 10 is dropped into a grassy area, the two edges 11-*m* will straddle the grass and provide a firm footing. This is by contrast with other anchors, such as those of the Danforth type, which land on grassy areas and rest with their entire surfaces in contract with the grass, so that it is difficult for them to penetrate to the sea floor.

Figure 3B:
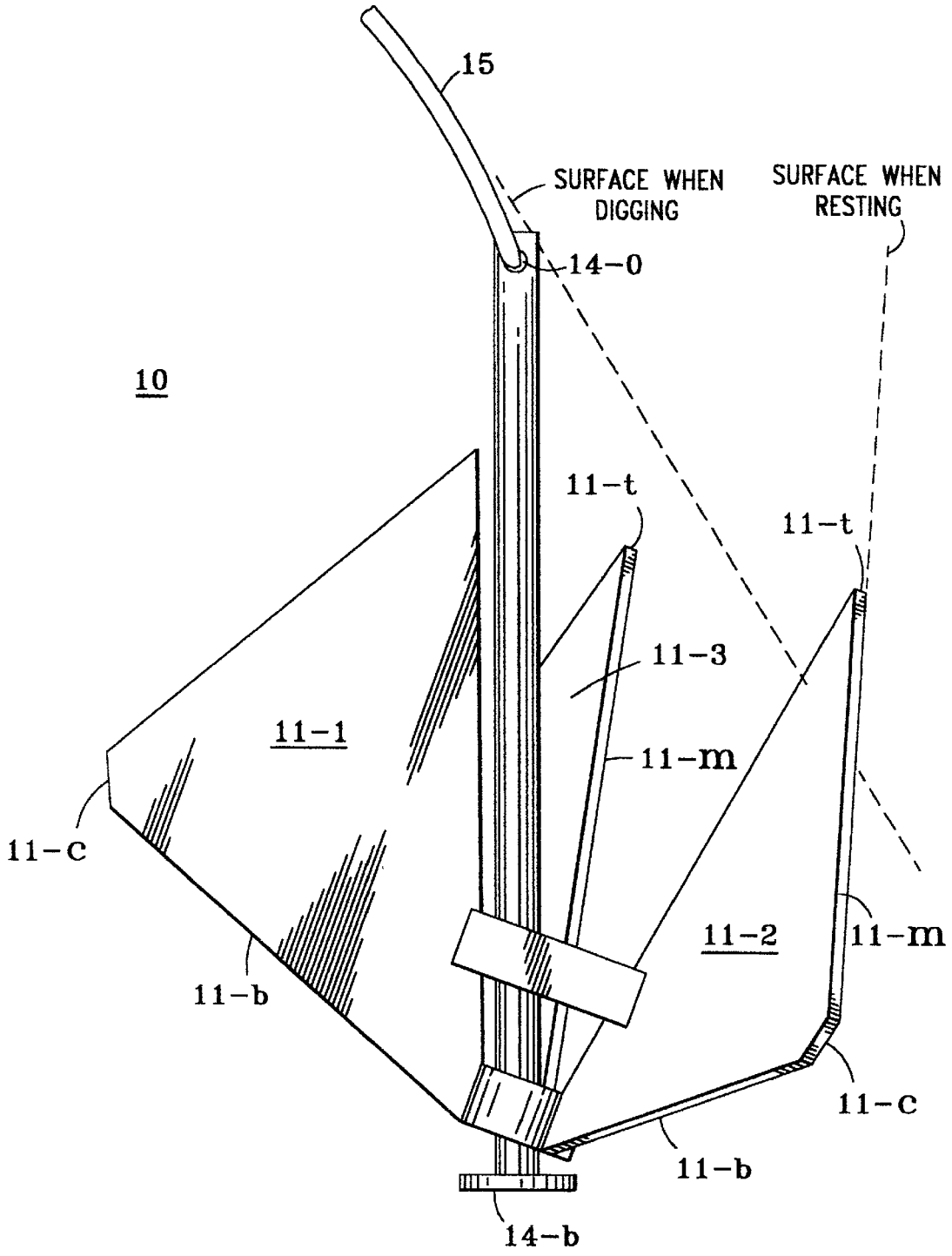

FIG. 3B illustrates the position of the anchor 10, as seen from the side, when the tips 11-*t* have started to penetrate into the marine floor. As explained earlier the rode 15 adopts the configuration of the sea water creates a pulling action against the anchor 10. The rode pulls horizontally and friction from the non-aligned edges straddling the grass or other debris causes the anchor to rise up on two of its tips 11-*t* and engage the sea floor leading to penetration where the sea floor is sufficiently soft or engaging rocks or other obstructions in other cases.

With the anchor 10 of the invention, force is concentrated on two points of the tips 11-*t* to enable the tips to quickly and easily penetrate to the sea floor.

While the fluke edges, such as the base edge 11-*b*, are shown as straight, they may be curved or angled to help sea floor penetration. Similarly, the corners 11-*c* may be rounded to prevent any fouling by the anchor rode 15 on the anchor 10.

Figure 4A:
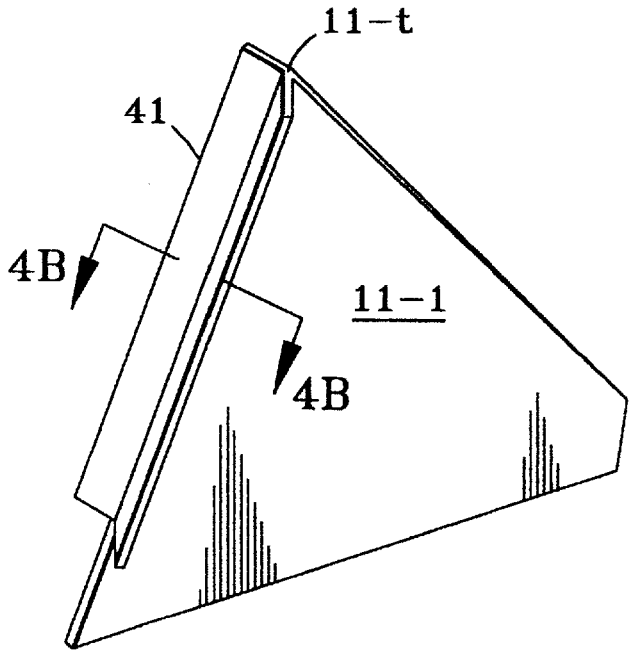
FIG. 4A is a perspective view of a modified fluke in accordance with the invention.
Figure 4B:
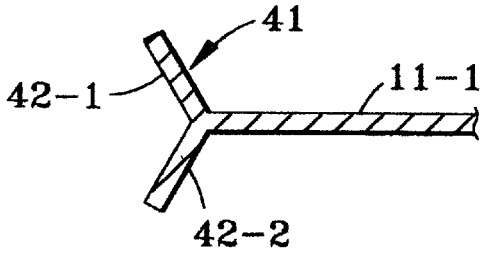
FIG. 4B is a cross-sectional view of the modified fluke of FIG. 4A taken along the lines 4B–4B.
Figure 4C:
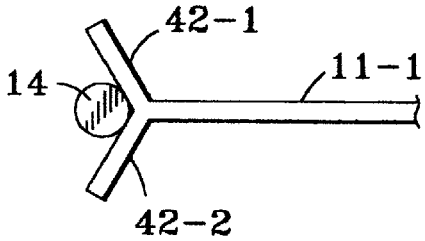
FIG. 4C shows the modified fluke of FIG. 4B cradling a shaft in accordance with the invention.

The fluke tips 11-*t*, which are used to pierce the surface of the sea floor, desirably are reinforced by the addition of a "V" shaped pieces to the inside leading edge of each fluke. As illustrated by FIG. 4A, the fluke 11-1 has "V"-shaped reinforcement 41 extending along the edge 11-*k*. It will be understood that other forms of reinforcement may be employed and, such as having a constant taper, instead of a tip taper with a constant section. As indicated in FIG. 4B, the reinforcement 41 has side walls 42-1 and 42-2 which form an angle of about 120 degrees, but other angular separations may be employed as well.

In addition, the reinforcement 41 can cradle the shaft 14 when the fluke 11-1 is pulled at an angle. Reinforcement ribs can be placed on the surface 11-*s* to provide additional reinforcement and help prevent the tips from rising when there is pull at an angle. The shaft 14, even with a straight pull, will deflect and rest on the inside edge 11-*k* of the top fluke. The "V" shaped guide reinforcement 41 insures that the shaft will remain confined.

When two flukes are engaged, such as the flukes 11-2 and 11-3 of FIG. 3B, the shank 14 shields the fluke 11-1, which is not involved in any digging action, so that no additional friction is created to hinder penetration of the sea floor. In addition, when the anchor 10 of the invention is under stress, the shank 14 rests against the inside edge 11-*c* of the associated fluke which provides reinforcement for the shank 14 even in the absence of the specific reinforcement 41 shown in FIG. 4A.

The flukes 11-1, 11-2 and 11-3 also have apertures 11-*a* which are of assistance in storage.

With reference to FIGS. 5–8, the drawings illustrate various modifications of the marine anchor 10 of the invention shown in FIG. 1.

Figure 5:
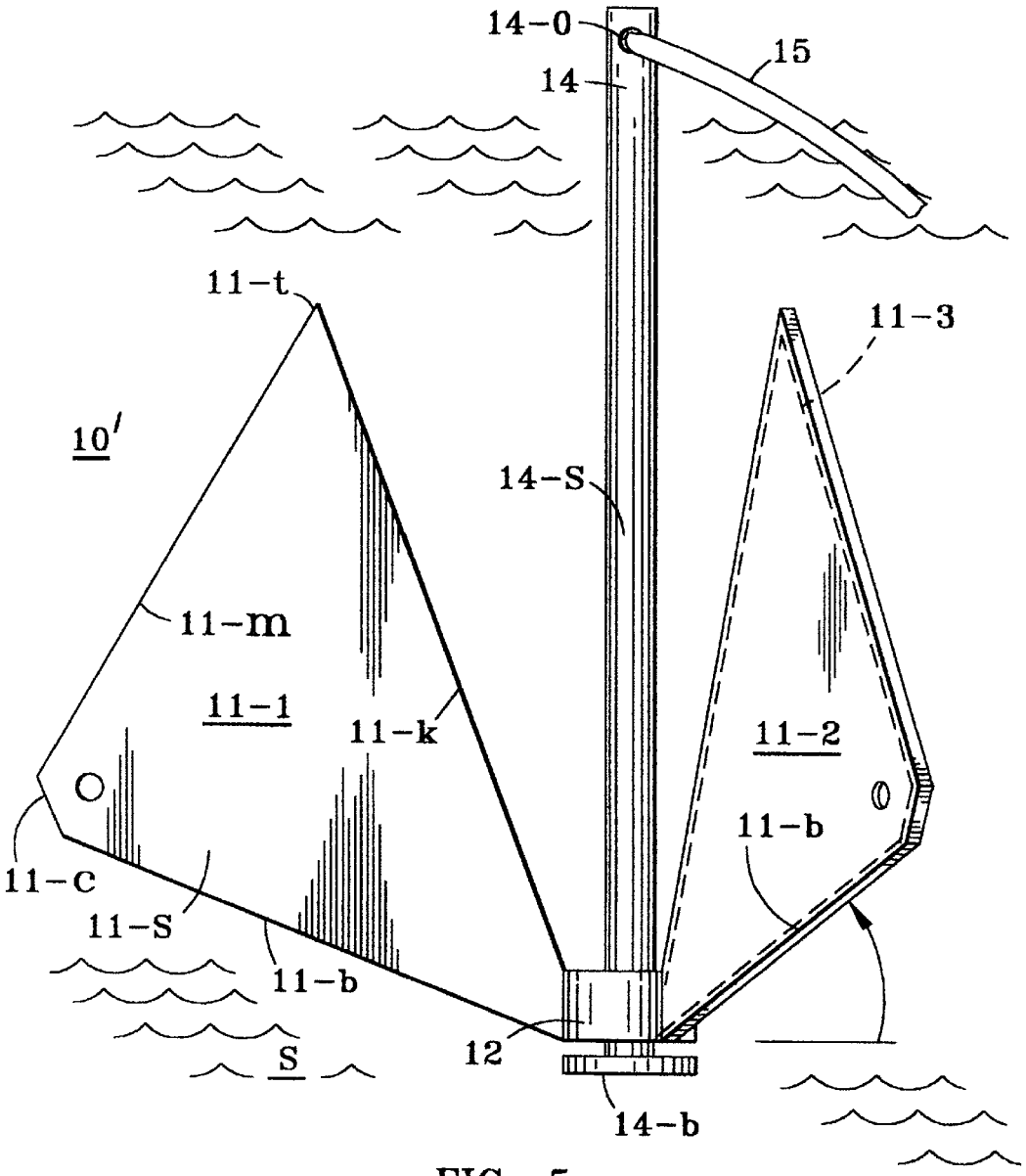
FIG. 5 is a side view of a marine anchor in accordance with another aspect of the invention, standing upright with three flukes above a surface.

In the view of FIG. 5, the modified anchor 10' has been positioned with the fluke 11-1 having its base edge 11-*b* directly above a surface S, and corresponding edges 11-*b* of the remaining flukes 11-2 and 11-3 are elevated above the surface S.

Extending retractably through a constraint 12 is a shank 14 by which the anchor 10' can be elevated and lowered into position on a marine surface. A rode or cable 15 is attached to the end of the shank 14 for that purpose and is seen hanging loosely in FIG. 5.

The constraint edge 11-*k* of each fluke 11-1, 11-2 and 11-3 is attached only to the constraint 12' and the connecting parts are proportioned and structured to assure that the flukes will remain attached to the constraint 12' regardless of encountered conditions. In the case of the triangular crown with hole, the base 11-*b* of the fluke is truncated and welded to the crown.

Figure 6:
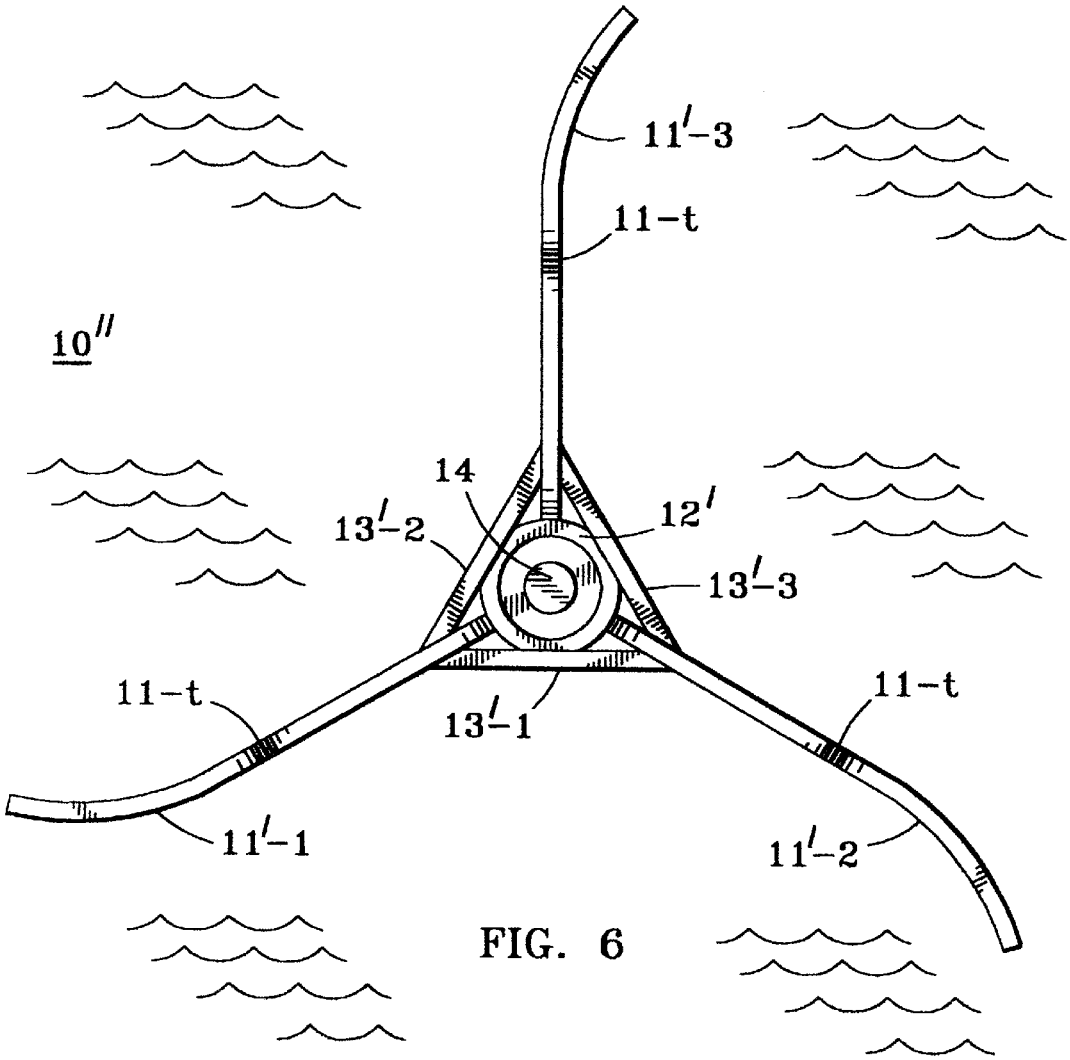
FIG. 6 is a top view of a modification of the marine anchor of FIG. 1, as seen when being lowered into water.

It will be appreciated that the constraint 12 may adopt a wide variety of forms and be, for example, triangular as illustrated in FIG. 6 where the constraint 12' is in the form of a substantially equilateral triangular plate having a central aperture that loosely surrounds the shank 14.

The inside edge of the constraint 12' may have a filed groove (not shown) to aid alignment of the associated shank and fluke.

By contrast with the anchor 10 of FIG. 1, the anchor 10" of FIG. 6 has curved flukes 11'-1, 11'-2 and 11'-3 that extend linearly from the corners of the constraint 12'.

It will be appreciated that while planar flukes are preferred, other non-planar configurations may be employed as well in addition to the curved configuration of FIG. 6. In addition, while an overall triangular configuration is preferred for the flukes, whether planar or curved, other fluke configurations and shapes may be used as well.

As indicated in FIGS. 5 and 6, the shank 14 is retractably and loosely centered on the constraints 12 and 12'. In addition to confining the shank shaft within the inside edges of the flukes, the constraint 12 acts against the shank base 14-*b*.

The shank base 14-*b* is movable in relation to the constraint 12, and prevents the shank 14 from being pulled away from the anchor 10'.

As the anchor 10" is dropped into water, it is seen from above as shown in FIG. 6. The flukes 11'-1, 11'-2 and 11'-3 are substantially uniformly distributed around the triangular constraint 12' and one of the segments 13'-1, 13'-2 or 13'-3 spans the approximately 120 degree interval between adjoining flukes.

Figure 7:
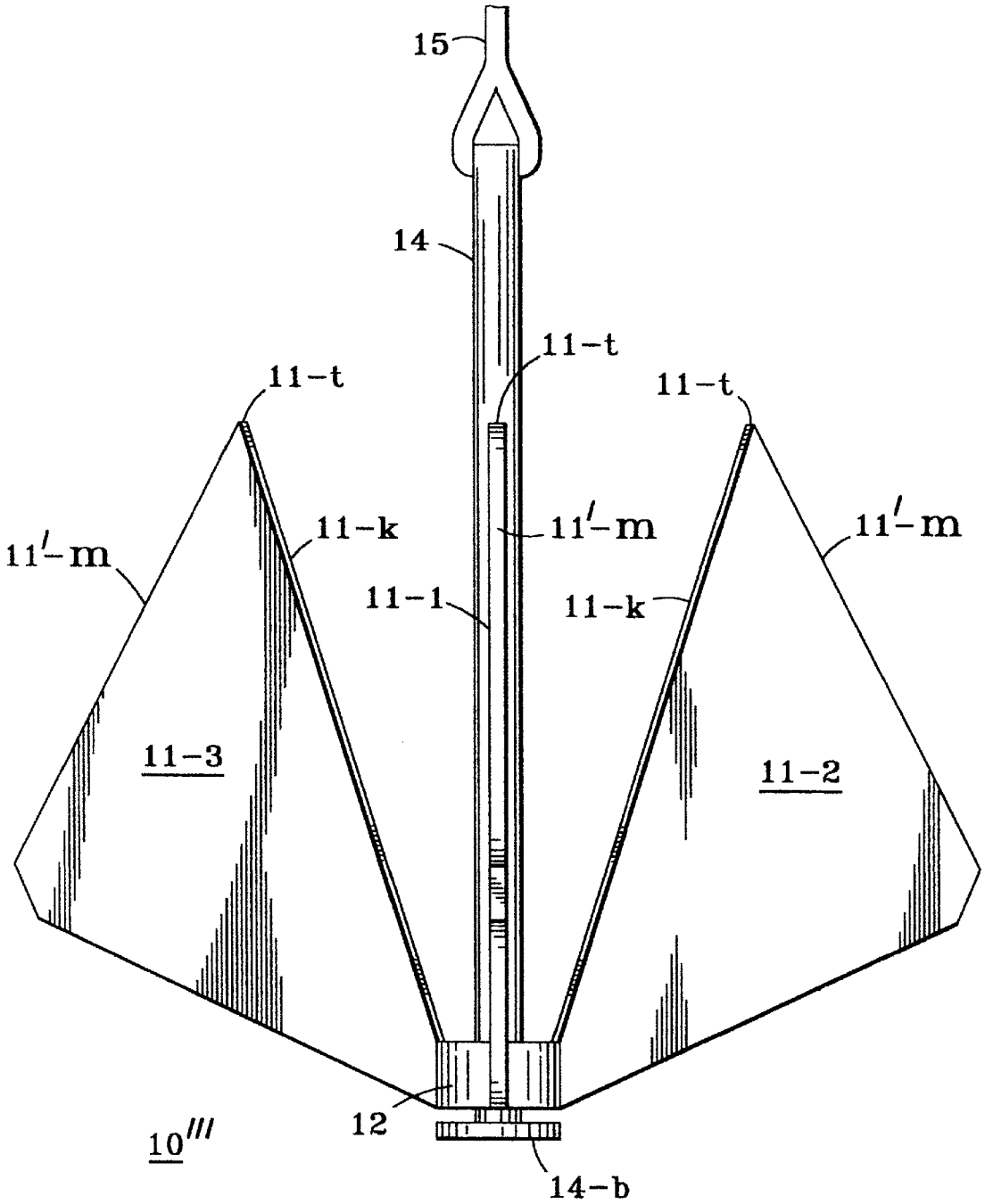
FIG. 7 is a side view of a further modification of the marine anchor of FIG. 1.

As shown in FIG. 7, when the anchor 10'" reaches the marine floor, it takes on the appearance, again as seen from above, and rests on only two of its edges 11'-*m*. If the anchor 10'" is dropped into a grassy area, the two edges As shown in FIG. 7, when the anchor 10'" reaches the marine floor, it takes on the appearance, again as seen from above, and rests on only two of its edges 11'-*m*. If the anchor 10'" is dropped into a grassy area, the two edges 11'-*m* will straddle the grass and provide a firm footing. This is by contrast with other anchors, such as those of the Danforth type, which land on grassy areas and rest with their entire surfaces in contract with the grass, so that it is difficult for them to penetrate to the sea floor.

In the modified anchor 10'" of FIG. 7, the flukes are displaced from the bottom edge of the constraint 12, and other displacements may be made as well.

Figure 8:
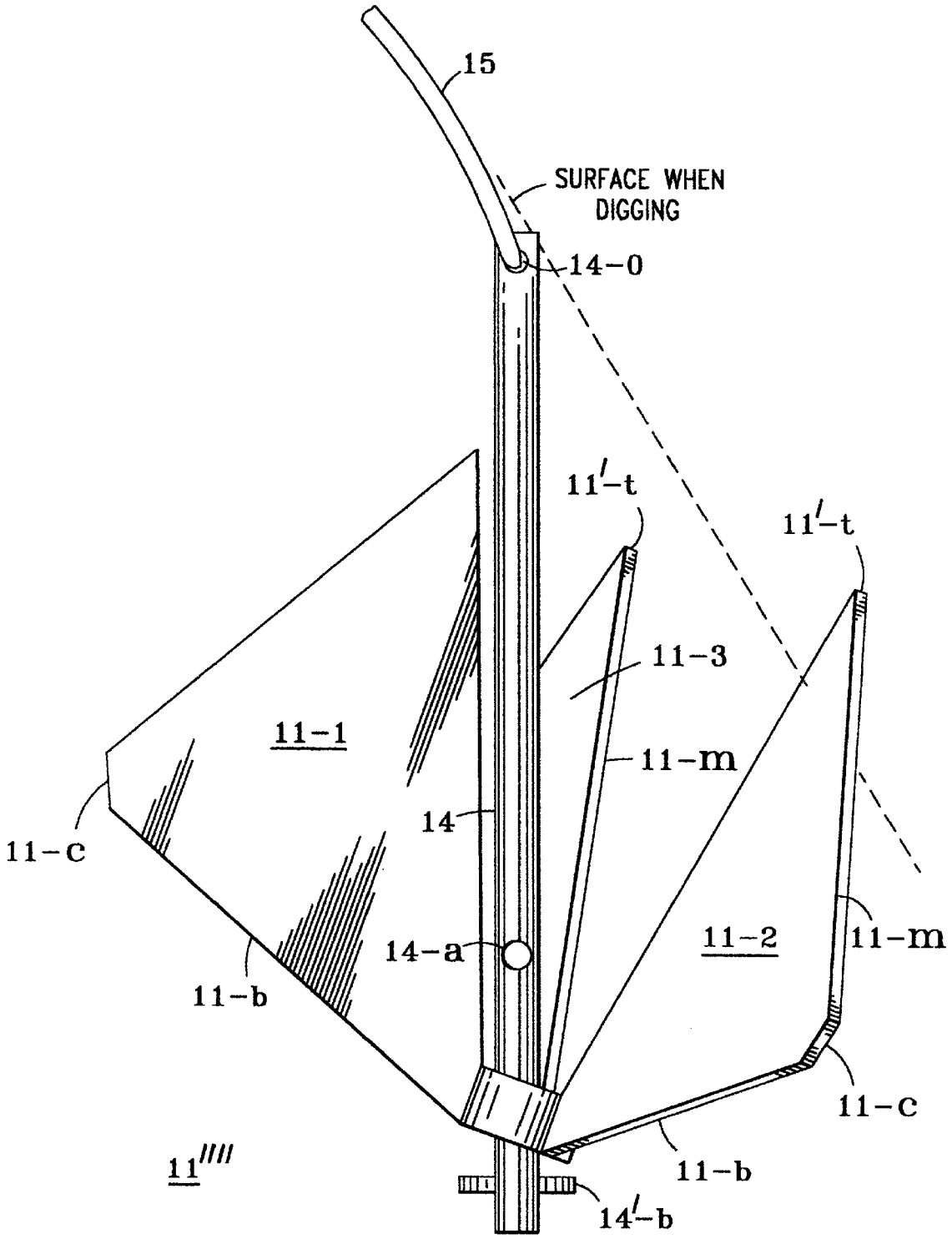
FIG. 8 is a side view of still another modification of the marine anchor of FIG. 1, as seen after having been dropped into contact to dig into a water covered surface.

FIG. 8 illustrates the position of a modified anchor 10"", as seen from the side, when the tips 11'-*t* have started to penetrate into the marine floor. As explained earlier the rode 15 adopts the configuration of a catenary and the motion of the sea water creates a pulling action against the anchor 10"". The rode pulls horizontally and friction from the non-aligned edges straddling the grass or other debris causes the anchor to rise up on two of its tips 11'-*t* and engage the sea floor leading to penetration where the sea floor is sufficiently soft or engaging rocks or other obstructions in other cases.

For the anchor 10"", the base cap 14-*b* of FIG. 1 has been replaced by a through-pin 14'-*b* and an aperture 14-*a* is included at an intermediate location along the shank 14 in order to limit the retractability of the constraint 12 when a retention member, such as a through-pin or bolt, is inserted into the aperture 14-*a*.

With the anchors of the invention, force is concentrated on two points of the tips to enable the tips to quickly and easily penetrate to the sea floor.

It will be understood that the foregoing detailed description is illustrative only and that other implementations and uses of the invention will be apparent to those of ordinary skill in the art.

What is claimed is:

1. Apparatus for the anchoring of a floating object comprising an elongated shank;

a constraint tiltably surrounding and retractably mounted on said shank; and a plurality of flukes attached to said constraint and extending along the vicinity of said shank.

2. Apparatus as defined in claim 1 including a further fluke attached to said constraint and extending along the vicinity of said shank.

3. Apparatus as defined in claim 2 wherein said constraint is triangular with an aperture therein for retractable mounting on said shank.

4. Apparatus as defined in claim 1 wherein said shank includes an aperture therethrough for receiving means by which the retraction of said constraint along said shank can be limited.

5. Apparatus as defined in claim 1 wherein said fluke is displaceably mounted on said constraint beyond an end thereof.

6. Apparatus as defined in claim 1 wherein said flukes are selected from the class of planar and non-planar flukes.

7. Apparatus as defined in claim 1 wherein said fluke is attached perpendicularly to said constraint, which loosely surrounds said shank.

8. Apparatus as defined in claim 1 wherein said shank is terminated by means for retaining said constraint on said shank.

9. Apparatus as defined in claim 8 wherein the retaining means comprises an end cap.

10. Apparatus as defined in claim 8 wherein the retaining means comprises an aperture extending through said shank displaced from the end thereof for receiving means for retaining said constraint retractably on said shank.

11. Apparatus as defined in claim 1 wherein said shank includes means at an intermediate position therealong for limiting the retractability of said constraint.

12. Apparatus as defined in claim 11 wherein the limiting means comprises an aperture extending through said shank for receiving means for retaining said constraint retractably on said shank.

13. The method of fabricating apparatus for the anchoring of floating objects, which comprises the steps of (a) providing an elongated shank;

(b) tiltably and retractably mounting a constraint loosely surrounding said shank;

(c) attaching a fluke to said constraint to extend along the vicinity of said shank.

14. The method of claim 13 further including the step of displacably attaching said fluke to said constraint.

15. The method of claim 13 further including the step of providing means at an intermediate location of said shank for limiting the retractability of said constraint.

16. The method of claim 13 further including the step of terminating said shank with means for retaining said constraint on said shank.

17. The method of anchoring of a floating object, comprising the steps of (a) lowering to a fluid floor an anchor having a shank tiltably surrounded by a constraint with a fluke having an elongated edge opposite said shank;

(b) penetrating marine growth by tilting said constraint with its fluke to reach said fluid floor; and (c) positioning said elongated edge of said fluke against said fluid floor with said shank opposite said fluke.

18. The method of claim 17 further including the step of lowering said anchor with a plurality of flukes uniformly distributed about said shank of said anchor.

19. The method of claim 18 wherein said flukes have edges that intersect to form tips further including the step of causing said tips to penetrate said fluid floor;

thereby to enhance the anchoring of said floating object.

20. The method of claim 19 further including the step of attaching a rode to said anchor to control the lowering thereof to said fluid floor wherein said rode adopts the configuration of catenary which promotes said anchoring.

* * * * *